United States Patent [19]

Osberghaus et al.

[11] Patent Number: 4,863,629

[45] Date of Patent: Sep. 5, 1989

[54] CLEANING PREPARATIONS FOR HARD SURFACES

[75] Inventors: Rainer Osberghaus, Duesseldorf; Karl-Heinz Rogmann, Ratingen; Birgit Froehlich, Duesseldorf, all of Fed. Rep. of Germany

[73] Assignee: Henkel Kommanditgesellschaft auf Aktien, Duesseldorf, Fed. Rep. of Germany

[21] Appl. No.: 183,815

[22] Filed: Apr. 20, 1988

[30] Foreign Application Priority Data

Apr. 27, 1987 [DE] Fed. Rep. of Germany ..... 3713998

[51] Int. Cl.[4] ..... D21D 3/00; D21H 3/80

[52] U.S. Cl. ..... 252/162; 252/526; 252/550; 252/174.11; 252/174.21; 252/DIG. 11

[58] Field of Search ..... 252/162, 170, 171, 526, 252/550, 174.11, 174.21, DIG. 11

[56] References Cited

U.S. PATENT DOCUMENTS

| | | | |
|---|---|---|---|
| 3,463,735 | 8/1969 | Stonebraker et al. | 252/137 |
| 3,696,043 | 10/1972 | Labarge et al. | 252/153 |
| 3,882,038 | 5/1975 | Clayton et al. | 252/164 |
| 3,939,090 | 2/1976 | Zmoda et al. | 252/90 |
| 4,017,409 | 4/1977 | Demessemaekers et al. | 252/109 |

*Primary Examiner*—Paul Lieberman
*Assistant Examiner*—John F. McNally
*Attorney, Agent, or Firm*—Ernest G. Szoke; Wayne C. Jaeschke; Henry E. Millson, Jr.

[57] ABSTRACT

Aqueous cleaning preparations for hard surfaces containing surfactants and from 1 to 20% by weight propylene glycol tert.-butyl ether as an essential component.

22 Claims, No Drawings

CLEANING PREPARATIONS FOR HARD SURFACES

BACKGROUND OF THE INVENTION

1. Field of the Invention

This invention relates to a liquid cleaning preparation for hard surfaces, more especially surfaces of glass and ceramics.

2. Statement of Related Art

Conventional cleaning preparations for hard surfaces are generally aqueous preparations which are present either as solutions or as suspensions and which are commercially available in liquid or paste-like form. The principal constituents of preparations such as these are surfactants, complexing agents for the hardness constituents of water, abrasives, and organic solvents, the quantity in which the individual constituents are present being variable within wide limits according to the particular application. Cleaning preparations especially intended for the cleaning of glass and ceramic surfaces are frequently formulated as solutions of the active components in a mixture of water and water-soluble organic solvents, primarily lower alcohols and glycol ethers. Examples of preparations such as these can be found in U.S. Pat. Nos. 3,696,043; 3,463,735; 3,882,038; and 3,939,090.

Apart from the obvious need for high cleaning power, cleaning preparations of the above type are also required to lend themselves to simple and convenient application. At the same time, the preparations are often required to develop an almost automatic effect, i.e. they are expected to provide the desired effect after only a single application without any further treatments. This is difficult to achieve, particularly where the preparations are applied to smooth surfaces, more especially to smooth surfaces which, like glass or ceramics, are capable of mirror-like reflection. In general, it is necessary with conventional preparations to rinse off residues of the preparations after the actual cleaning process or to carefully polish and dry the surfaces after application to avoid visible residues on the smooth surfaces.

STATEMENT OF THE INVENTION

Other than in the operating examples, or where otherwise indicated, all numbers expressing quantities of ingredients or reaction conditions used herein are to be understood as modified in all instances by the term "about".

An object of the present invention is to provide an improved preparation which is particularly suitable for the cleaning of glass and ceramic surfaces.

The present invention relates to a liquid cleaning preparation for hard surfaces which contains the following components:

from 1 to 20% by weight surfactant which is an anionic surfactant a nonionic surfactant, an amphoteric surfactant, or a mixture thereof, from 1 to 20% by weight propylene glycol tert.-butyl ether, with the proviso that no more than 50% of this ether can be replaced by another solvent which is a $C_2$–$C_3$ alcohol, a $C_4$–$C_8$ glycol ether, or a mixture thereof, from 0 to 10% by weight of at least one solubilizer, from 0 to 1% by weight of at least one viscosity regulator, from 0 to 8% by weight of at least one complexing agent for alkaline earth ions from 0 to 2% by weight of other auxiliaries and additives, and ad 100% by weight water.

The present invention also relates to the use of these preparations for cleaning hard surfaces, more especially of glass and ceramics.

The preparations of the invention are distinguished by an excellent cleaning effect and, in addition, show a particularly pronounced clear-drying effect on reflective surfaces. This means that the liquid residues remaining on the surfaces after the cleaning process dry in such a way that virtually no solid residues are visible to the naked eye. In this way, the surfaces retain their shine without any need for subsequent rinsing or polishing. It is assumed that the particularly advantageous properties of the preparations are attributable to the interaction of the propylene glycol tert.-butyl ether with the other active constituent or constituents.

The individual constituents of the preparations of the invention will now be described:

(1) Surfactants

Surfactants suitable for use in the compositions of the invention are surfactants of the anionic, nonionic and amphoteric type. Mixtures of anionic and nonionic surfactants are preferably used. The surfactant component is present in the preparations in a quantity of from 1 to 20% by weight, preferably in a quantity of from 2 to 15% by weight, and more preferably in a quantity of from 3 to 8% by weight.

Suitable anionic surfactants include alkanesulfonates containing from 12 to 20 carbon atoms in the alkyl group, monoalkyl sulfates containing 12 to 14 carbon atoms in the alkyl group, and alkyl ether sulfates containing from 12 to 18 carbon atoms in the alkyl group and from 2 to 6 ethylene oxide units (EO) in the ether portion. Examples of such surfactants are sodium lauryl ether sulfate containing 2 EO, sodium coconut alkyl sulfate and sodium sec.-alkanesulfonate containing approximately 15 carbon atoms.

Particularly suitable anionic surfactants include alkanesulfonates containing from 12 to 20 carbon atoms in the alkyl group and, preferably, alkyl ether sulfates containing from 12 to 14 carbon atoms in the alkyl group and from 2 to 6 ethylene oxide units (EO) in the ether portion.

The nonionic surfactants used include, primarily, ethoxylated long-chain alcohols containing from 12 to 18 carbon atoms in the alkyl group and from 5 to 15 ethylene oxide units (EO), ethoxylated alkylphenols containing from 8 to 10 carbon atoms in the alkyl group and from 8 to 14 ethylene oxide units, ethoxylated fatty acid amides containing from 12 to 18 carbon atoms in the fatty acid part and from 2 to 8 ethylene oxide units, and long-chain amine oxides containing from 14 to 20 carbon atoms. Examples of such surfactants include oleyl cetyl alcohol containing 10 EO, nonylphenol containing 10 EO, lauric-myristic acid diethanolamide, coconut fatty acid polydiethanolamide, and coconut alkyl dimethyl amine oxide.

The adducts of ethylene oxide and fatty alcohols, alkylphenols, and fatty acid amides have proven to be particularly suitable nonionic surfactants for use herein.

(b) Propylene glycol tert.-butyl ether

This constituent, which is particularly important to the invention, is the monotert.-butyl ether of 1,2-propylene glycol corresponding to the following formula:

$$(CH_3)_3—C—O—CH_2—CH(CH_3)—OH$$

This ether can be used in chemically pure form for use in the compositions of the invention, although it is advantageously used in technical quality, which generally has a purity of around 95%, for economic reasons. This solvent is a liquid which shows limited miscibility with water and which has a boiling point of 151° C. In cooperation with the other ingredients of the compositions of the invention, this ether seems to be responsible for the outstanding clear-drying effect of the preparations. It is present in the compositions in a quantity of from 1 to 20% by weight, preferably in a quantity of from 2 to 15% by weight, more preferably in a quantity of from 3 to 15% by weight, and most preferably in a quantity of from 2 to 10% by weight.

The effect of the propylene glycol tert.-butyl ether is particularly pronounced where it is present as sole organic solvent in the cleaning preparations. Accordingly, no more than 50% (e.g. from 1 to 50%) and, preferably, no more than 30% of its content in the cleaning preparations should be replaced by other solvents. Such partial replacement solvents include $C_2$–$C_3$ alcohols and other $C_4$–$C_8$ glycol ethers.

(c) Solubilizers

Depending on the type and quantity of ingredients used, it may be necessary to use solubilizers where the preparations are intended to have the appearance of a clear solution. Suitable solubilizers include, for example, short-chain monoalkyl sulfates containing from 4 to 10 carbon atoms in the alkyl part, alkyl benzenesulfonates containing from 1 to 6 carbon atoms in the alkyl part, and urea. Examples of such solubilizers include sodium-n-octyl sulfate and sodium toluenesulfonate.

The lower alkyl benzenesulfonates containing from 1 to 3 carbon atoms in the alkyl chains, and urea are preferred. The quantity of solubilizer in the preparations can be up to 10% by weight; 0.5% by weight is regarded as the lower limit of effectiveness. The solubilizer is preferably used in a quantity of from 1 to 5% by weight.

(d) Viscosity regulators

In many cases, it may be desirable optimally to adapt the viscosity of the preparations of the invention to the particular application. This may be done by suitable choice of the components or by the addition of a viscosity regulator. Hydrophilic synthetic and modified natural polymers are particularly suitable for the compositions of the invention.

Among these polymers, cellulose derivatives, for example methyl hydroxypropyl cellulose and hydroxyethyl cellulose, are particularly preferred. The viscosity regulators can be present in a quantity of up to 1% by weight, although in many cases satisfactory results are obtained with only 0.1% by weight.

(e) Complexing agents for alkaline earth ions

Basically, any known water-soluble complexing agents for alkaline earth ions, such as condensed phosphates, polymeric carboxylic acids and low molecular weight organic complexing agents, are suitable for the preparations of the invention. Low molecular weight water-soluble complexing agents of the polycarboxylic acid, hydroxycarboxylic acid, aminopolycarboxylic acid, and polyphosphonic acid type are preferred. They can be used both in the form of the free acids and also in the form of water-soluble salts, generally sodium salts. Nitrilotriacetic acid, citric acid, gluconic acid, and salts thereof are particularly preferred. The complexing agents can be present in the preparations in quantities of up to 8% by weight, quantities of from 0.1 to 5% by weight being preferred.

(f) Auxiliaries and additives

In addition to the active substances mentioned above, the preparations of the invention may contain auxiliaries and additives of the type normally present in such preparations, including in particular dyes, perfume oils and preservatives. Such additives are normally present in quantities of no more than 2% by weight, based on the preparation as a whole. The lower limit to the quantity used depends upon the type of additive and, in the case of dyes for example, may be 0.001% by weight or lower. The auxiliaries and additives are preferably present in quantities of from 0.01 to 1% by weight.

The compositions of the invention are applied by first diluting the compositions with water, preferably in a volume ratio of from 1:200 to 1:20, and more preferably in a ratio of from 1:100 to 1:50 (cleaning composition:-water). The surfaces to be treated are then wiped with the dilute solution thus prepared, for example using a sponge or a cloth. Further treatment of the surfaces is not necessary because the cleaning solutions dry without leaving any streaks and do not leave behind any dulling residues or marks, even on critical high-gloss surfaces. In general, the cleaning preparation is only used in relatively high concentrations or in undiluted form on heavily marked surfaces. Such surface is then cleaned as described above with the dilute cleaning solution.

The invention will be illustrated but not limited by the following examples.

EXAMPLES

1. Cleaning preparations

A cleaning preparation according to the invention was prepared with the following composition:

| | |
|---|---|
| $C_{16}$ alkanesulfonate | 5.0% by weight |
| Coconut alcohol + 10 EO | 3.0% by weight |
| Cumenesulfonate | 2.5% by weight |
| Citric acid | 0.3% by weight |
| Preservative | 0.013% by weight |
| Dye | 0.009% by weight |
| Propylene glycol mono-tert.-butyl ether | 5.0% by weight |
| Balance water | |

It was prepared by dissolving the individual components in water.

When used in the form of a 5% solution, even on black tiles and on mirrors, the cleaning preparation produced clean, streak-free surfaces with virtually no visible residues without subsequent polishing and drying.

Where a 1:1 mixture of propylene glycol tert.-butyl ether and diethylene glycol monobutyl ether was used instead of the propylene glycol tert.-butyl ether, only slightly poorer results were obtained.

2. Comparison tests

The preparation of Example 1 was compared with respect to its cleaning effect and clear-drying effect with other preparations which contained the same quantity of another water-soluble solvent for otherwise the same composition. The clear-drying effect was tested by allowing 100 ml of a 5% solution of the cleaning preparation to run down a sloping black tile and evaluating the appearance of the tile after drying of the liquid. The evaluation scale extended from 0 (=completely unchanged shine) to 10 (heavily dulled). The cleaning effect of the preparations was tested by wiping a light grey tile which had been soiled with a test soil of 60% calcium soap, 20% mineral oil and 20% Vaseline. Once again, the tile was neither subsequently rinsed nor polished. The evaluation scale again extended from 0 (free from residues) to 10 (heavy residues). The results are shown in the following Table:

TABLE

| Organic solvent | Clear-drying effect (black tile) | Cleaning effect (grey tile) |
|---|---|---|
| Isopropanol | 4 | 6 |
| Propylene glycol monomethyl ether | 4 | 5 |
| Dipropylene glycol monomethyl ether | 4 | 5 |
| Ethylene glycol monobutyl ether | 2 | 2 |
| Diethylene glycol monobutyl ether | 2 | 3 |
| Propylene glycol monotert.-butyl ether | 0 | 1 |
| Propylene glycol monotert.-butyl ether + diethylene glycol monobutyl ether (1:1) | 1 | 2 |

The results clearly show that preparations based on propylene glycol tert.-butyl ether are distinctly superior to the other preparations based on conventional solvents.

Equally good result were obtained with preparations which contained the sodium salt of a coconut alcohol+3.7 EO sulfate instead of alkanesulfonate or coconut fatty acid polydiethanolamide instead of the fatty alcohol ethoxylate.

We claim:

1. A liquid cleaning composition comprising:

A. from about 1 to about 20% by weight of at least one surfactant selected from the group consisting of anionic surfactants, nonionic surfactants, and amphoteric surfactants, B. from about 1 to about 20% of the weight of either
(a) propylene glycol mono-tert.-butyl ether, or
(b) a mixture of propylene glycol mono-tert.butyl ether and up to about 50% by weight of the mixture of at least one other solvent selected from the group consisting of $C_2$–$C_3$ alcohols and $C_4$–$C_8$ glycol ethers, C. from 0 to about 10% by weight of at least one solubilizer selected from the group consisting of monoalkyl sulfates containing from 4 to 10 carbon atoms in the alkyl part, alkyl benzenesulfonates containing from 1 to 6 carbon atoms in the alkyl part, and urea, D. from 0 to about 1% by weight of at least one viscosity regulator selected from the group consisting of hydrophilic synthetic and modified natural polymers, E. from 0 to about 8% by weight of at least one complexing agent for alkaline earth ions, F. from 0 to about 2% by weight of at least one other additive selected from the group consisting of dyes, perfume oils, and preservatives, and G. ad 100% by weight water.

2. The composition of claim 1 wherein the at least one surfactant in component A is at least one of an ether sulfate, an adduct of ethylene oxide and a fatty alcohol, an alkylphenol, and a fatty acid amide.

3. The composition of claim 1 wherein component C is present and is an alkyl benzenesulfonate containing from 1 to 3 carbon atoms in the alkyl part, urea, or a mixture thereof.

4. The composition of claim 1 wherein component E is nitrilotriacetic acid, citric acid, gluconic acid, a water-soluble salt of any of the foregoing, or a mixture of two or more of any of the foregoing.

5. The composition of claim 1 wherein in component B (b) no more than about 30% by weight of the mixture is the at least one other solvent.

6. The composition of claim 1 wherein component B (a) is present therein.

7. The composition of claim 1 wherein component A is present in from about 2 to about 15% by weight.

8. The composition of claim 1 wherein component A is present in from about 3 to about 8% by weight.

9. The composition of claim 1 wherein component B is present in from about 2 to about 15% by weight.

10. The composition of claim 1 wherein component B is present in from about 3 to about 15% by weight.

11. The composition of claim 1 wherein component B is present in from about 2 to about 10% by weight.

12. The composition of claim 7 wherein component B is present in from about 2 to about 15% by weight.

13. The composition of claim 8 wherein component B is present in from about 2 to about 10% by weight.

14. A liquid cleaning composition consisting essentially of:

A. from about 2 to about 15% by weight of at least one surfactant selected from the group consisting of alkyl ether sulfates, adducts of ethylene oxide and a fatty alcohol, alkylphenols, and fatty acid amides, B. from about 2 to about 10% by weight of propylene glycol tert.-butyl ether, C. from about 1 to about 5% by weight of at least one solubilizer selected from the group consisting of alkyl benzenesulfonates containing from 1 to 3 carbon atoms in the alkyl group, and urea, D. from about 0.1 to about 1% by weight of at least one water-soluble cellulose ether as a viscosity regulator, E. from about 0.1 to about 5% by weight of at least one complexing agent selected from the group consisting of nitrilotriacetic acid, citric acid, gluconic acid, and a water-soluble salt of any of the foregoing, F. from about 0.001 to about 1% by weight of at least one additive selected from the group consisting of dyes, preservatives, and perfume, and G. ad 100% by weight water.

15. A liquid cleaning composition which is the composition of claim 1 diluted with water in a volume ratio of composition of claim 1:water of from about 1:200 to about 1:20.

16. A liquid cleaning composition which is the composition of claim 1 diluted with water in a volume ratio of composition of claim 1:water of from about 1:100 to about 1:50.

17. A liquid cleaning composition which is the composition of claim 14 diluted with water in a volume ratio of composition of claim 14:water of from about 1:200 to about 1:20.

18. A liquid cleaning composition which is the composition of claim 14 diluted with water in a volume ratio of composition of claim 14:water of from about 1:100 to about 1:50.

19. A method for cleaning a hard surface comprising contacting the hard surface with the cleaning composition of claim 1.

20. A method for cleaning a hard surface comprising contacting the hard surface with the cleaning composition of claim 14.

21. A method for cleaning a hard surface comprising contacting the hard surface with the cleaning composition of claim 15.

22. A method for cleaning a hard surface comprising contacting the hard surface with the cleaning composition of claim 17.

* * * * *